US006647697B1

(12) United States Patent
Zarrow et al.

(10) Patent No.: US 6,647,697 B1
(45) Date of Patent: Nov. 18, 2003

(54) SELF-CONTAINED WRAP BAG

(75) Inventors: Nancy Zarrow, Wellesley, MA (US); Kenneth Buckley, Needham, MA (US)

(73) Assignee: Wrap Solutions, Inc., Needham, MA (US)

( * ) Notice: Subject to any disclaimer, the term of this patent is extended or adjusted under 35 U.S.C. 154(b) by 212 days.

(21) Appl. No.: 09/632,288

(22) Filed: Aug. 4, 2000

Related U.S. Application Data

(60) Provisional application No. 60/147,724, filed on Aug. 6, 1999.

(51) Int. Cl.[7] ..... B65B 5/02

(52) U.S. Cl. ..... 53/452; 206/461; 206/466; 206/806

(58) Field of Search ..... 53/469, 468, 473, 53/476, 484, 486, 452; 206/45.34, 45.31, 45.14, 461, 466, 806

(56) References Cited

U.S. PATENT DOCUMENTS 3,599,538 A * 8/1971 Piazze
3,814,303 A * 6/1974 Smith ..... 206/806
3,946,936 A * 3/1976 Brown ..... 206/806
4,211,329 A * 7/1980 Braverman ..... 206/806
4,279,376 A * 7/1981 Roccaforte ..... 206/806
4,395,863 A * 8/1983 Chaussadas et al. ..... 53/469
4,958,731 A * 9/1990 Calcerano
5,117,972 A * 6/1992 Herrin et al.
5,350,568 A * 9/1994 Tuckner et al.
5,499,484 A * 3/1996 Herrin ..... 53/468
5,595,047 A * 1/1997 Paumen et al.

* cited by examiner

*Primary Examiner*—Eugene Kim
*Assistant Examiner*—Sameh Tawfik
(74) *Attorney, Agent, or Firm*—Brian M. Dingman, Esq.; Mirick, O'Connell, DeMallie & Lougee, LLP

(57) ABSTRACT

Self-contained wrap for a gift comprising, a first panel; a second panel, having a perimeter, fixed to the first panel along a first portion of the perimeter, so that a cavity is formed between the first panel and the second panel which is adapted to enclose the gift therein, and so that at least one opening to the cavity is defined along a second portion of the perimeter which is adapted to allow the gift to be passed through the opening into the cavity; and at least one flap, fixed to the second panel, which is adapted to fold over the opening and to adhere to the front panel; and method for using the wrap.

4 Claims, 4 Drawing Sheets

SELF-CONTAINED WRAP BAG

This application claims the benefit of Provisional application Ser. No. 60/147,724, filed Aug 6, 1999.

FIELD OF THE INVENTION

This invention relates to gift wrapping materials and more specifically to self-contained gift wrap which provides the user with aesthetically pleasing, self-contained, preferably form-fitting gift wrap which is available for immediate use at the point of purchase and which does not require any extraneous tools or materials to wrap the gift.

BACKGROUND OF THE INVENTION

Gifts are conventionally wrapped by purchasing a roll of wrapping paper and a myriad of wrapping accessories, such as bows and ribbons; taking the paper home; gathering the tools needed, such as scissors and tape; measuring the amount of paper needed; cutting the paper to size; folding the paper around the gift, taping the tucks and folds as you go; sizing and cutting the ribbon to fit; tying the ribbon around the gift; and fixing a bow. As anyone who has wrapped a gift, the process is not as easy as it sounds. The paper, once unrolled, reveals holes, anomalies in the design and uneven edges. The paper also often rips in the process or is not big enough, so additional measuring and cutting, if not purchasing, are required. A person needs to have four arms to fold and tuck the paper around the gift, all the while holding the paper in place as you tear off yet another piece of tape. The tape itself adds its own characteristic problems to the operation including, repeated attempts to find the end of the tape on the roll and then, once the end is found, having the tape split along its length as you try to pull off a length; then once you are able to tear off a worthy piece and you attempt to maneuver the piece in position, the piece either sticks to itself or to anything else it can along the way.

Needless to say, some have taken up the cause to provide alternative items to make the gift wrapping process easier. These alternative items include gift bags with handles, gift boxes with a design printed on the outside surface of the box and wrapping paper that is pre-cut to fit a gift of a particular size. However, these alternatives introduce new concerns and do not address many of the already existing concerns. Gift bags and gift boxes are often either too large or too small for a particular gift and they require additional accessories, such as tissue paper or plastic grass, to fill undesirable space in the bag and to make the bag more appealing. Pre-cut paper, at best, merely obviates the need to measure and cut the paper if the paper does, in fact, match the size of the gift being wrapped. Pre-cut paper does not address any of the other problems associated with conventional wrapping. In many instances, pre-cut paper is worse than rolled paper because, unless the paper is precisely the correct size for wrapping a particular gift, which it usually is not, the paper may be to small or if too big, must be cut anyway. In any case, none of the alternative are cost efficient and still require extraneous materials or tools to produce an aesthetically pleasing product.

SUMMARY OF THE INVENTION

It is therefore a primary object of this invention to provide self-contained gift wrap which does not require extraneous tools or materials to wrap a gift; and a method for using the same.

It is a further object of this invention to provide gift wrap that may be utilized immediately at a point of purchase without the need for scissors or tape; and a method for using the same.

It is a further object of this invention to provide gift wrap, and a method for using the gift wrap, that is more convenient and easier to use than convention wrapping and still provides an aesthetically pleasing product without the need for space fillers, such as tissue paper, typically needed with gift bags and gift boxes.

It is a further object of this invention to provide self-contained gift wrap that may be readily adapted to form-fit one or more items having predefined forms and sizes.

A preferred embodiment of the self-contained wrap of this invention for wrapping a gift generally comprises: a first panel; a second panel, having a perimeter, fixed to the first panel along a first portion of the perimeter, so that a cavity is formed between the first panel and the second panel which is adapted to enclose the gift therein, and so that at least one opening to the cavity is defined along a second portion of the perimeter which is adapted to allow the gift to be passed through the opening into the cavity; and at least one flap, fixed to the second panel, which is adapted to fold over the opening and to adhere to the front panel. The wrap also may comprise at least one inwardly folded gusset which is adapted to a bottom panel and two side panels interposed between the first and second panels when the gift is enclosed within the cavity. Each of the side panels may further comprise at least one flap which is adapted to fold across at least a portion of the opening, before the flap is folded over the opening; and the front panel may further comprise a flap which is adapted to fold across at least a portion of the opening before the flap is folded over the opening. The wrap also preferably comprises a display tab, which is removably fixed to the flap and comprises at least one opening through the tab; and a means for removably fixing the tab to the flap. The panels of the gift wrap preferably comprise a thin, polymeric film and the adhesive provided on the flap is preferably of moderate adhesion strength so that the flap can be released from the front panel, if needed, without tearing the gift wrap.

Another preferred embodiment of the self-contained wrap of the invention for wrapping a gift having a predefined form, comprises: a first panel; a second panel, having a perimeter, fixed to the first panel along a first portion of the perimeter, so that a cavity is formed between the first panel and the second panel which is adapted to enclose the gift therein in a form-fitting manner, and so that at least one opening to the cavity is defined along a second portion of the perimeter which is adapted to allow the gift to be passed through the opening into the cavity; and at least one flap, fixed to the second panel, which is adapted to fold over the opening and to adhere to the front panel. Similarly, the wrap may further comprise at least one inwardly folded gusset which is adapted to form a bottom panel and two side panels when the gift is enclosed within the cavity. The gift wrap may be adapted to form-fit a specific gift item such as a compact disc or video cassette tape.

The preferred method of the invention for wrapping a gift, comprising the steps of: providing the gift; providing self-contained wrap comprising, a first panel; a second panel, having a perimeter, fixed to the first panel along a first portion of the perimeter, so that a cavity is formed between the first panel and the second panel which is adapted to enclose the gift therein, and so that at least one opening to the cavity is defined along a second portion of the perimeter which is adapted to allow the gift to be passed through the opening into the cavity; and at least one flap, fixed to the second panel and having an adhesive on at least a portion of the flap; inserting the gift into the cavity through the opening; and folding the flap over the opening and pressing the adhesive against the first panel.

This invention is the result of efforts to design convenient, quick and easy gift wrapping without sacrificing appearance. To be convenient, the wrap was designed to be wrapped around a gift on the spot (at the point of purchase) without extra materials or tools, such as scissors, tape, and a place to work. To be quick and easy, the wrap was designed to require less time, effort and skill than the conventional gift wrapping methods which typically involve cutting wrapping paper to size, folding and tucking corners and taping each fold and tuck.

To achieve a self-contained gift wrap that did not sacrifice appearance, the wrap was designed to produced finished product that looks as good as or better than a gift wrapped by conventional methods. The wrap of the invention is particularly suited for box-shaped gifts such as compact discs and video cassettes, although the wrap of the invention may be adapted to wrap gifts having virtually any shape by altering the size of the wrap and the location and number of gussets, openings and flaps. The wrap may also be provided with a variety of additional decorative accessories attached to the outside of wrap at appropriate positions, including, but not limited to, ribbons, stickers, novelty items, cards and preformed, flat bows which are readily opened into three-dimensional bows.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

Figure 1:
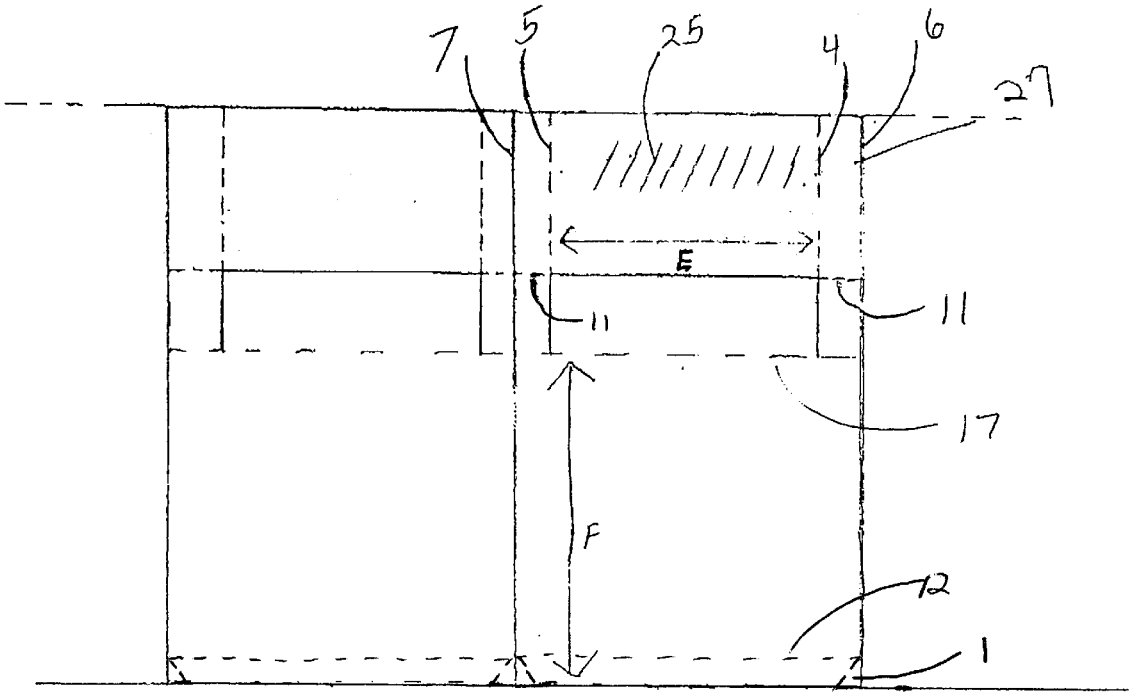
FIG. 1 is a front view of two partially assembled wraps, side-by-side, of the preferred embodiment of the gift wrap of the invention prior to cutting.
Figure 2:
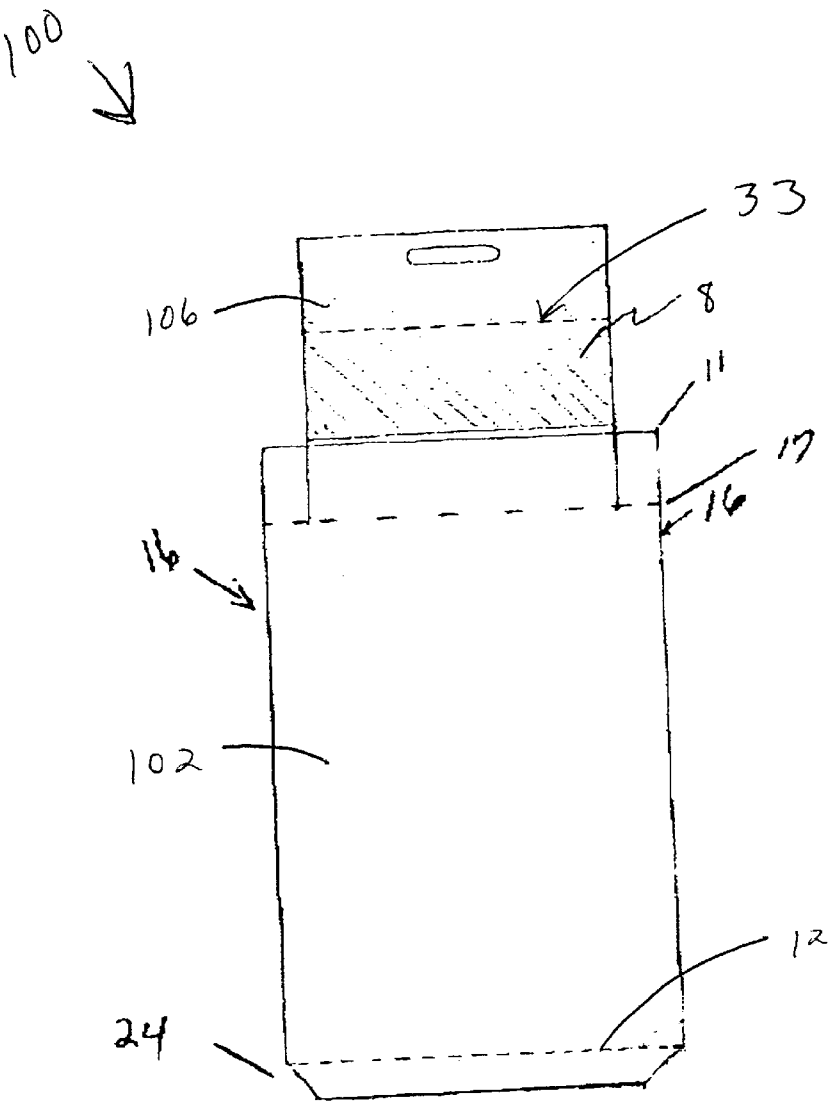
FIG. 2 is a front view of the preferred embodiment of the gift wrap of the invention, unexpanded, showing the inwardly folded gusset and upper fold line of the front panel in phantom.
Figure 3:
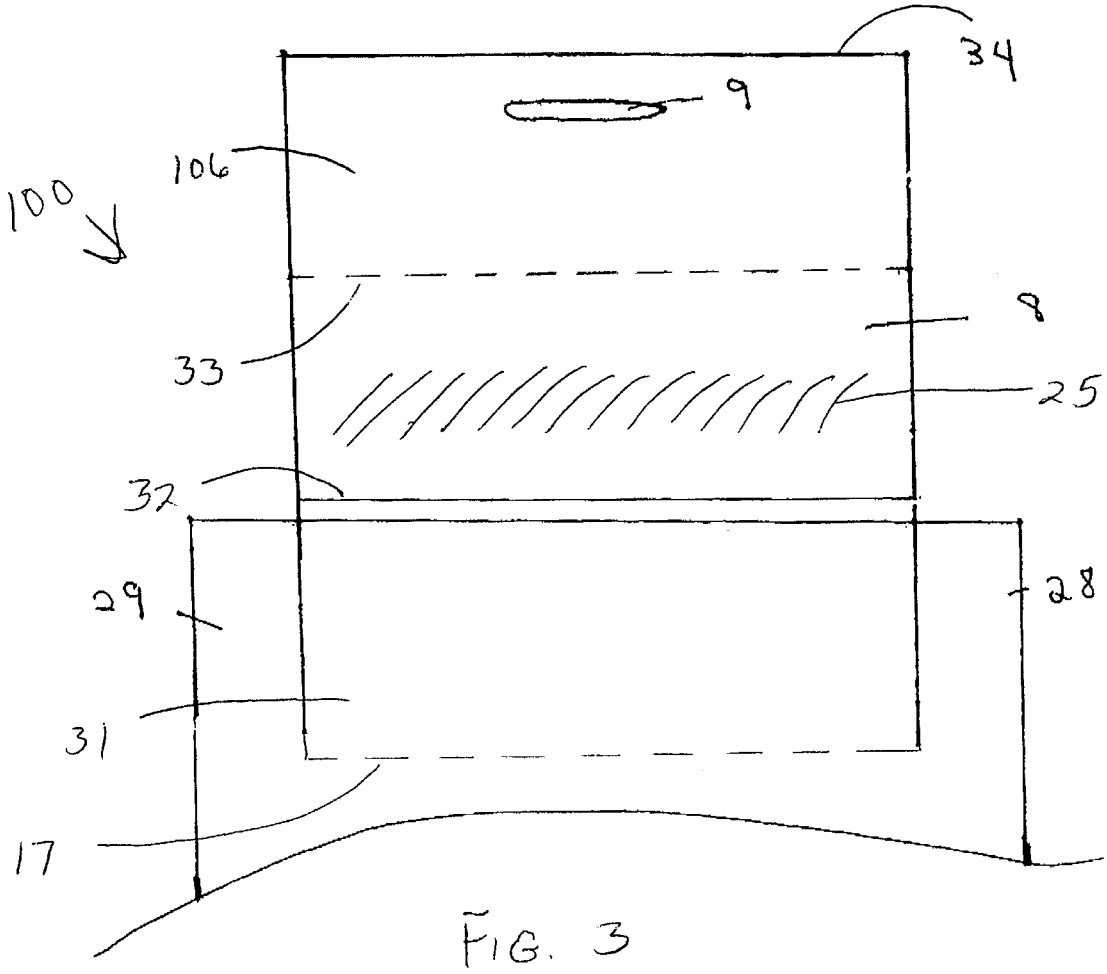
FIG. 3 is an enlarged partial front view of the upper portion of the preferred embodiment, unexpanded, shown in FIG. 2.

The self-contained wrap of the invention for wrapping a gift generally is made up of a front panel and a back panel which are sealed together along their vertical side edges and integral with each other along an inwardly folded bottom gusset, which together form a cavity with an opening to the cavity at the top edges of the front and back panel. The back panel is provided with a flap which extends upwards from the top edge of the back panel. An adhesive is provided on the flap which is adapted to fold over the opening, after a gift is inserted into the wrap, and adhesively seal to the front panel. Together, the panels resemble a bag with a flap which folds over the top of the bag to close the opening. The gusset allows the bag to be expanded to accommodate items having some bulk to them. The gift wrap also preferably is provided with a tab which is releasably fixed to the flap and has an opening in the tab to enable the tab, and thus the gift wrap, to be hung from a hook on a retail display at a point of purchase.

FIGS. 1–4 illustrate a preferred embodiment of the gift wrap of this invention which is generally referred to in the drawings as gift bag 100. The bag is may be made from a variety of plastic film combinations, which are printed with a variety of ink mixtures depending on the desired designs. For example, gift bag 100 is preferably made from oriented polypropylene (OPP), 20 micron thick which is printed on the underside with the design showing through the clear OPP. Opaque ink is used for matte colors and translucent ink is used for metallic colors. The OPP is used as a printed roll, typically thousands of yards long. The width of the printed roll should be the length of the largest, bag to be made, where the length is equal to the combined height of front panel 102, back panel 104, front flap 31, back flap 8 and gusset 24. The height and width of the front and back panels will depend on the width and height of the gift as shown by arrows E and F, respectively.

After printing, the roll is dry laminated on one side to metallic cast polypropylene (Met CPP), 25 microns thick for a total of 45 microns. A powder coating is added to the inner metallic side to limit friction as the gift is inserted into the bag. FIG. 1 shows the wrap of the invention while it is still part of the roll. Specifically FIG. 1 shows two bags side-by-side and as yet, uncut from the roll.

Figure 4:
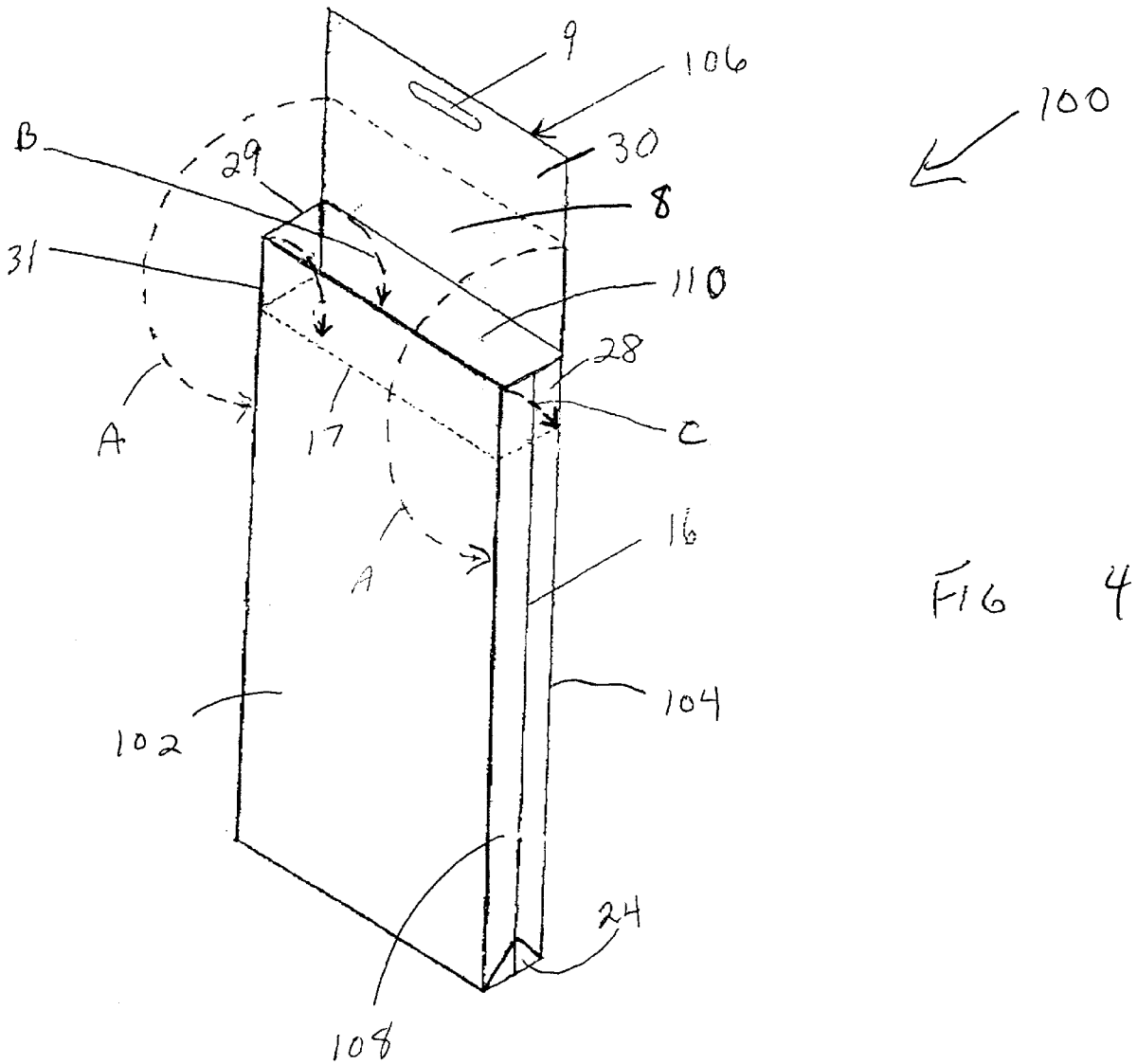
FIG. 4 is a perspective view of the preferred embodiment shown in FIG. 2, expanded, with arrows schematically showing part of the preferred method of use of the invention.

The roll of printed OPP is fed into a converter machine that forms the bag and inwardly folded bottom gusset 24 in a manner disclosed in U.S. Pat. No. 3,599,538. The convertor machine applies adhesive 25 and peel off tab 106 which is sized to cover the entire back flap 8. The converter machine also seals the side seams between front panel 102 and back panel 104, which later become the centerline 16 of the side panels (e.g. side panel 108) when the gift wrap is expanded as shown in FIG. 4. The convertor machine further makes the top cuts along lines 4, 5, 6, 7 and 11, to form side flaps 28 and 29, front flap 31 and back flap 9 which fold down, respectively, over the top opening 110 after the gift (not shown) is inserted into the cavity of gift bag 100 as shown by arrows B, C and A, respectively, in FIG. 4. The extraneous material removed between the back flaps of successive bags on the roll, as a result of the cuts, is discarded. Gusset 24 is an inwardly folded gusset with an inwardly folded centerline 12 (FIG. 2) and corner-cut seams 1 (FIG. 1).

As noted, removable tab 106 is applied to back flap 8 to completely cover back flap 8, as shown by the lower edge 32 of tab 106 (FIG. 3), and to extend above the top edge 33 of back flap 8 so that the upper edge 34 of tab 106 is far enough above the top edge 33 of back flap 8 to allow opening 9 to be cut out of tab 106. Tab 106 is removably applied by using an adhesive adapted for temporary adhesion or of moderate strength. The same adhesive 25 provided on back flap 8 for adhering back flap 8 to front panel 102 when the back flap 8 is folded over opening 110, also provides the adhesive used to removably apply tab 106 to back flap 8. Tab 106 is removed, by pulling tab 106 gently off of back flap 8, before back flap 8 is folded over opening 110 and pressed onto front panel 102. Tab 106 is peeled off to expose adhesive 25 provided underneath the lower portion of tab 106. Opening 9 of tab 106 may be cut out in-line by the convertor machine or as a separate operation. Opening 9 enables the finished gift bag to be hung from a retail display at the point of purchase.

The gift wrap of the invention provides numerous features and improvements over existing gift wrap and gift wrap materials. For example, by using plastic instead of paper, there is less risk of the plastic tearing when the gift is inserted into the gift bag. By forming a gusset in the gift wrap of the invention, the gusset eliminates the permanent crease associated with paper gift bags which is typically parallel to and near the bottom of a gift bag created so that the paper gift back may be folded flat. The gusset further eliminates the need to apply glue to the bottom of a gift bag to hold the folded edges of the paper bag together. The plastic material also expands the design variables available for use in the gift wrap. For example, the material may be printed on the top, or if the inking material is subject to marring, the material may also, or alternatively, be printed on the underside of the translucent plastic.

The OPP also allows the decorative design to be printed to the very the edge of the bag. Whether sealing a metallic design to a metallic design or an OPP design to an OPP design, the heat seal will seal both types of designs. These features of the gift bag, in part, enable the gusset of the gift bag to be utilized. For example, there are 4 seams inside a gusset. The seam inside the fold has printing against printing and if the design were printed on the metallic directly without the OPP layer, that inside seam would not seal. However, by printing on OPP and laminating to the metallic, it is possible to produce a metallic design on a bag made of durable plastic, that has a square bottom for a form fit and yet have the print design extend to the edge of the seam. In addition, the design of the gift wrap of the invention also allows multiple sizes to be cut from the same, uniform width roll and provides a seamless front and back panel.

Tab 106 extends beyond the upper edge of back panel 8, not only to provide room in the tab for opening 9, but also to provide extra room in the tab above the adhesive for printing information such as a bar code and/or instructions for assembling the wrapping. By printing the bar code and instruction on the removable tab, once the tab is removed and discarded, the finished gift wrap is pristine in appearance, unlike the gift bags currently available which have various types of information printed on the side or bottom of the bags. The opening provided in the tab also overcomes the problems associated with displaying and stocking a product that is too flexible to support itself in conventional product displays, such as card racks. 10.

Further, by using an adhesive of medium adhering strength, the gift wrap remains closed until such time that the recipient wishes to remove it and yet the gift wrap is capable of being opened without tearing the bag and with using scissors. The design of the gift wrap is optimized so that the gift wrap may be reused if desired.

The method of the invention for wrapping a gift using the gift wrap of the invention is accomplished by opening the bag by inserting a hand and puffing the panels of the bag outward, then inserting the gift into the cavity of the bag through the top opening. When the gift is pushed completely to the bottom, which forces the gusset to open into the form-fitting bottom corners, the side flaps 28 and 29 are then tucked in toward each other in the direction of arrows B over at least a portion of opening 110 along line 17 (FIG. 4). The front panel flap 31 is then folded in the direction of arrow C along line 17 over at least a portion of opening 110 (FIG. 4). Peel off tab 106 is then removed and back panel flap 8 is folded in the direction of arrows A completely over opening 110 along line 17 and extending at least partially down the front of front panel 102 and pressed into placed. Flap 8 is held in place against front panel 102 by adhesive 25. As noted above, adhesive 25 should be of moderate adhesive strength so that flap 8 can be peeled off front panel 102 reaffixed to panel 102, without tearing the wrap, to adjust the position of flap 8 if needed or to reuse the gift wrap.

The gift wrap of the invention is designed so that various ornamental items can be applied to the outside surface of the gift wrap such as a self-adhesive bow and card to enhance the appearance of the wrapped gift much like a gift that has been wrapped using conventional methods and yet in a fraction of the time.

Although specific features of the invention are shown in some drawings and not others, this is for convenience only as some feature may be combined with any or all of the other features in accordance with the invention. Other embodiments will occur to those skilled in the art and are within the following claims:

What is claimed is:

1. Self-contained wrap bag for attractively and fully covering an object, comprising:

a first panel comprising a thin polymeric film printed entirely with a decorative design;

a second panel comprising a thin polymeric film printed entirely with a decorative design, and having a perimeter, said second panel fixed to said first panel by sealing along side edges of said panels along a first portion of said perimeter, so that a cavity is formed between said first panel and said second panel which is adapted to enclose said gift therein, and so that an opening to said cavity is defined along a second portion of said perimeter which is adapted to allow said gift to be passed through said opening into said cavity;

at least one flap, integral with said second panel and extending above said first panel, which is adapted to fold over said opening and to adhere to said first panel;

an adhesive on said flap adapted to adhere said flap to said first panel when said flap is folded over said opening and pressed against said first panel, to seal a gift within said cavity;

an inwardly-folded gusset which is adapted to form a bottom panel interposed between said first and second panels when said gift is enclosed within said cavity; and a display tab removably adhered to said adhesive on said flap, said display tab extending above said flap to define a product hanging area, said tab defining an opening in said product hanging area adapted to allow said wrap to be hung in a retail display;

wherein said display tab can be removed from said flap by pulling it off said adhesive, to thereby expose said adhesive so that it may adhere said flap to said first panel, to thereby close said wrap.

2. The wrap bag of claim 1, further comprising at least one side flap which is adapted to fold across a portion of said opening, before said flap that is integral with said second panel is folded over said opening.

3. The wrap bag of claim 2, wherein there are two side flaps, each made by partial cuts in the portions of said first and second panels adjacent to said opening.

4. The wrap bag of claim 3, wherein the partial cuts are spaced from the edges of the panels by an amount equal to the depth of the gusset fold.

* * * * *